US011600399B2

(12) United States Patent
McNeil et al.

(10) Patent No.: US 11,600,399 B2
(45) Date of Patent: Mar. 7, 2023

(54) NEUTRON EMITTING DEVICES

(71) Applicant: Kansas State University Research Foundation, Manhattan, KS (US)

(72) Inventors: Walter McNeil, Manhattan, KS (US); Amir Bahadori, Manhattan, KS (US); Diego Laramore, Webster, TX (US)

(73) Assignee: Kansas State University Research Foundation, Manhattan, KS (US)

( * ) Notice: Subject to any disclaimer, the term of this patent is extended or adjusted under 35 U.S.C. 154(b) by 0 days.

(21) Appl. No.: 17/270,537

(22) PCT Filed: Aug. 23, 2019

(86) PCT No.: PCT/US2019/047925
§ 371 (c)(1),
(2) Date: Feb. 23, 2021

(87) PCT Pub. No.: WO2020/041713
PCT Pub. Date: Feb. 27, 2020

(65) Prior Publication Data

US 2021/0193343 A1 Jun. 24, 2021

Related U.S. Application Data

(60) Provisional application No. 62/722,030, filed on Aug. 23, 2018.

(51) Int. Cl.
*G21G 4/02* (2006.01)
*G21K 1/04* (2006.01)

(52) U.S. Cl.
CPC ..... *G21G 4/02* (2013.01); *G21K 1/04* (2013.01)

(58) Field of Classification Search
CPC .. G21G 4/02; G21G 4/06; G21K 1/04; G21K 1/08
See application file for complete search history.

(56) References Cited

U.S. PATENT DOCUMENTS

| | | | | |
|---|---|---|---|---|
| 3,389,257 | A | 6/1968 | Caldwell et al. | |
| 4,829,191 | A | 5/1989 | Boyar et al. | |
| 2011/0001065 | A1 | 1/2011 | Popa-Simil et al. | |
| 2016/0327679 | A1 | 11/2016 | Luo et al. | |
| 2020/0103537 | A1* | 4/2020 | Lee | G01V 5/0091 |

OTHER PUBLICATIONS

International Search Report and Written Opinion in corresponding PCT/US2019/047925, dated Dec. 5, 2019.

* cited by examiner

*Primary Examiner* — Jack W Keith
*Assistant Examiner* — Joshua C Devorkin
(74) *Attorney, Agent, or Firm* — Hovey Williams LLP

(57) ABSTRACT

Microsized devices operable to emit neutrons in a selective manner are provided. The devices are configured so that the rate of neutron emission can be varied, either actively or passively. The devices comprise an a-particle emitting material and a neutron producing target material that when aligned and/or positioned a predetermined distance apart emit neutrons. The rate of neutron emission can be slowed or stopped by taking the materials out of alignment and/or attenuating the α-particles being directed toward the neutron producing target material.

10 Claims, 11 Drawing Sheets

NEUTRON EMITTING DEVICES

CROSS-REFERENCE TO RELATED APPLICATIONS

The present application is the U.S. National Stage of International Patent Application No. PCT/US2019/047925, filed Aug. 23, 2019, which claims the priority benefit of U.S. Provisional Patent Application No. 62/722,030, filed Aug. 23, 2018, each of which is incorporated by reference in its entirety herein.

BACKGROUND OF THE INVENTION

Field of the Invention

The present invention is generally directed toward devices that are operable to emit neutrons. The devices can be micro-fabricated and can be operated in active or passive modes. The devices utilize a nuclear reaction between two materials that are separated by a space through which α-particles may be transmitted.

Description of the Prior Art

Passive sources of neutrons are generally "on" all the time, meaning that they continuously emit neutrons. Efforts are underway in research and industry to replace these passive devices with "machine" sources of neutrons that can be turned on and off as desired. Machine sources of neutrons to-date are all some type of particle accelerator or plasma devices, which are massive in size and consume enormous amounts of power.

Neutron sources are presently used in measurement, interrogation, imaging, physics experiments and nuclear reactor cores. However, as can be appreciated, broad scale application of neutron emitting devices in these areas, and others, is limited to the aforementioned shortcomings.

Therefore, a need exists in the art for smaller devices capable of emitting neutrons that require little to no external power to operate.

SUMMARY OF THE INVENTION

According to one embodiment of the present invention there is provided a neutron emitting device that comprises an α-particle emitting material located on a first substrate, a neutron producing target material located on a second substrate, and an α-particle attenuating material disposed therebetween. The α-particle emitting material and the neutron producing material are oriented in facing relationship and initially separated from each other by a distance, $d_0$. The distance between the first and second substrates is variable between $d_0$ and a second distance, $d_1$, due to a change in the position of at least one of the first and second substrates. The change in position from $d_0$ to $d_1$ results in a change in the rate of neutrons emitted by the device.

According to another embodiment of the present invention there is provided a neutron emitting device that comprises a first substrate comprising an α-particle emitting material and a second substrate comprising a neutron producing target material. The first and second substrates are arranged in a stacked relationship with the α-particle emitting material and the neutron producing target material facing an interstitial space between the first and second substrates. The device is configured to emit neutrons when a line of sight exists between at least a portion of the α-particle emitting material and the neutron producing target material.

According to still another embodiment of the present invention there is provided a method of selectively producing neutrons. The method comprises providing a neutron emitting device comprising an α-particle emitting material on a first substrate, a neutron producing target material located on a second substrate, and an α-particle attenuating material disposed therebetween. The α-particle attenuating material and the neutron producing material are oriented in facing relationship and initially separated from each other by a distance, $d_0$. The distance between the first and second substrates is then changed, or caused to be changed, to a second distance $d_1$. The change in distance results in a change in the rate of neutrons being emitted from the device.

According to yet another embodiment of the present invention there is provided a method of selectively producing neutrons. The method comprises providing a neutron emitting device that includes a first substrate comprising an α-particle emitting material and a second substrate comprising a neutron producing target material. The first and second substrates are arranged in a stacked relationship with the α-particle emitting material and the neutron producing target material facing an interstitial space between the first and second substrates. The view factor, a property that describes the geometric line of sight between an emitting surface and a target surface, between the α-particle emitting material and the neutron producing target material is changed. The change in the view factor results in either an increase or a decrease in the rate of neutrons being emitted by the device.

Figure 1:
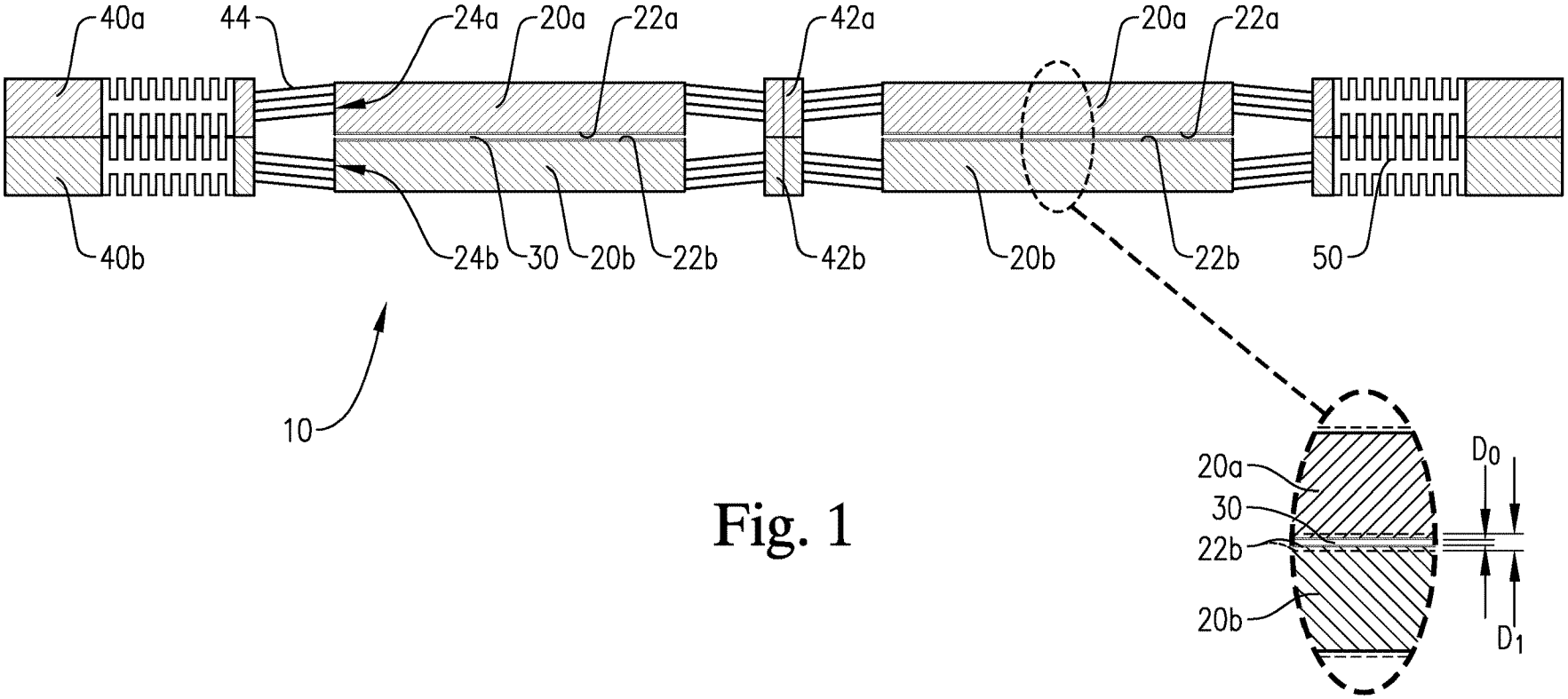
FIG. 1 is a schematic illustration of one embodiment of an attenuating-type neutron emitting device in accordance with the present invention.

While the drawings $d_0$ not necessarily provide exact dimensions or tolerances for the illustrated components or structures, the drawings are to scale with respect to the relationships between the components of the structures illustrated in the drawings.

DETAILED DESCRIPTION OF THE PREFERRED EMBODIMENT

Embodiments of the present invention are generally directed to neutron emitting devices and methods of selectively producing neutrons using the devices. The devices and methods are capable of producing neutrons from the alpha interactions between an alpha particle (α-particle) emitting material and a neutron producing target material. Alpha particles consist of two protons and two neutrons bound together into a particle identical to a helium-4 nucleus and are generally produced in the process of alpha decay. Neutrons are produced when alpha particles from a radioisotope of an element impinge upon certain low-atomic-weight isotopes of a target element. The alpha interactions can be manipulated by the devices in various ways described below so as to increase, decrease, or completely stop the production of neutrons. The devices and methods of the present invention advantageously use the passive material interactions to produce neutrons (i.e., no accelerator). Thus, in practicing methods according to certain embodiments of the invention, the devices can be turned on and off (or increased and decreased) with no power or can be cycled or pulsed with very minimal power to mimic machine sources. In certain embodiments, the α-particle emitting material comprises a radioisotope of actinium, thorium, uranium, neptunium, francium, astatine, bismuth, curium, californium, protactinium, americium, radium, polonium, and/or plutonium. In certain preferred embodiments, the α-particle emitting material comprises americium-241 dioxide. Polonium can also be a preferred α-particle emitting material in certain applications. Polonium has the benefit of not emitting other types of radiation, such as X-rays, and is sometimes referred to as a "pure" alpha source, as opposed to other materials that may emit other forms of radiation and/or particles, which are not essential to the production of neutrons. It is further noted that the initial deposition material which comprises the α-particle emitting material initially may be non-radioactive and is subsequently activated using neutrons or particle accelerators. In certain embodiments, the neutron producing targeting material comprises beryllium, lithium, carbon, and/or oxygen. In certain preferred embodiments, the neutron producing target material comprises beryllium oxide. Particularly preferred combinations of materials include americium-beryllium (AmBe), plutonium-beryllium (PuBe), and americium-lithium (AmLi). In certain embodiments, it can be advantageous for the neutron producing target material to comprise lithium as there is less energy contained in the neutrons that are emitted, which can be useful in certain applications.

In one or more embodiments of the present invention, there is provided a neutron emitting device configured to change the rate of neutron emission by exploiting the short range of α-particles in a dense medium. Particularly, the rate of neutron emission can be controlled by actively or passively changing the distance between the α-particle emitting material and the neutron producing target material with an α-particle attenuating medium disposed therebetween. One embodiment is shown in FIG. 1, although it will be understood that this embodiment is merely exemplary and other device configurations are within the scope of the present invention. FIG. 1 shows a device 10 configured for "chevron" style linear motion amplification. Device 10 comprises at least one upper substrate 20*a* and at least one lower substrate 20*b*. The terms "upper" and "lower" are used herein to describe expediently the relative spatial relationship between certain components of the device 10 as shown in the orientation in FIG. 1 and should not be taken as denoting an absolute orientation or configuration. It will be understood that the device 10 may have different orientations depending on the particular application for the device, for example, such that substrate 20*a* is the lower substrate and substrate 20*b* is the upper substrate, or such that the substrates are arranged vertically side-by-side. A preferred substrate material is silicon, however, any material that is relatively opaque with respect to α-particle transmission and/or transparent to neutron transmission, may be used. In the embodiment of FIG. 1, the α-particle emitting material is located on lower surface 22*a* of upper substrate 20*a*, and the neutron producing target material is located on the upper surface 22*b* of lower substrate 20*b*. The surfaces are configured such that the α-particle emitting material and the neutron producing material are oriented in facing relationship (i.e., facing a common interstitial space between upper substrate 20*a* and lower substrate 20*b*, which as explained below is occupied by an α-particle attenuating material). The α-particle emitting material and neutron producing target material can be applied to the substrate surfaces in a variety of ways known in the art. In certain embodiments, the α-particle emitting material is applied using a foil deposition technique, although other application techniques can be used within the scope of the present invention.

An α-particle attenuating material 30 is disposed generally between upper substrate 20*a* and lower substrate 20*b*, and more specifically between the α-particle emitting material and neutron producing target material. The α-particle attenuating material 30 can be any of a variety of materials capable of attenuating alpha particles emitted toward the neutron producing material such that varying the distance between the materials causes the rate of neutron emissions to vary. In certain embodiments, the α-particle attenuating material 30 is a fluid material and may be present elsewhere in the device where there is no physical barrier preventing the spread of the fluid. Preferably, the α-particle attenuation material 30 is sufficiently dense so as to provide attenuation of alpha particles over short distances while being able to deform and flow between the moving parts of the device. In certain embodiments, the α-particle attenuating material 30 comprises a "heavy" liquid (i.e., a liquid having a density greater than 2.0 $g \cdot cm^{-3}$). In preferred embodiments, the α-particle attenuating material 30 comprises liquid mercury.

As shown in the embodiment of FIG. 1, upper substrate 20*a* and lower substrate 20*b* each comprise a moveable shuttle having spaced apart end segments 24*a*, 24*b*. As noted above, the shuttles are moveable due to the chevron style linear motion amplification configuration. Specifically, each shuttle end segment 24*a*, 24*b* is secured to an exterior bearing 40*a*, 40*b*, or a central bearing 42*a*, 42*b* when there are two or more upper substrates 20*a* and lower substrates 20*b* such as shown in the embodiment of FIG. 1. End segments 24*a*, 24*b* are secured to bearings 40*a*, 40*b* or 42*a*, 42*b* by one or more deflectable legs 44.

In certain embodiments, device 10 further comprises at least one dampener 50 located in between at least one of the one or more legs 44 and one of the exterior bearings 40*a*, 40*b*. In long style shuttle configurations, such as shown in FIG. 1, the additional springs of dampener 50 can help to reduce stress on legs 44 and help to prevent structural failure of device 10.

In operation, the α-particle emitting material and the neutron producing material located on upper substrate 20*a* and lower substrate 20*b*, respectively, are initially separated from each other by a distance, $d_0$. The distance between the lower surface 22*a* of upper substrate 20*a* and the upper surface 22*b* of lower substrate 20*b* is variable between $d_0$ and a second distance, $d_1$, due to a change in the position of at least one of the substrates 20*a*, 20*b*. Due at least in part to the presence of the α-particle attenuating material 30 between the α-particle emitting material and neutron producing target material, a change in position from $d_0$ to $d_1$ results in a change in the amount of α-particles interacting with the neutron producing material and thus also a change in the rate of neutrons emitted by the device. The initial distance, $d_0$, will depend on a number of factors, including the particular α-particle emitting material, neutron producing material, and α-particle attenuating material used, as well as the particular application for the device. For example, in certain embodiments, the initial distance, $d_0$, is selected so as to emit a high, or even maximum, rate of neutrons from the device when positioned at $d_0$. In such embodiments, a change from $d_0$ to $d_1$ will cause the rate of neutrons being emitted from the device to decrease or cease entirely. However, in other embodiments, the initial distance, $d_0$, is selected so as to emit a low rate of neutrons or no neutrons at all from the device when positioned at $d_0$. In such embodiments, a change from $d_0$ to $d_1$ can cause the rate of neutrons being emitted from the device to increase.

The change in distance from $d_0$ to $d_1$ is generally caused by an application of force, either active or passive, on one or more components of device 10. In certain embodiments, such as shown in FIG. 1, the change in distance from $d_0$ to $d_1$ is caused by an application of a force (e.g., a lateral tension or compression force) to at least one of the bearings 40*a*, 40*b*. Lateral tension or compression forces acting on bearings 40*a*, 40*b* in turn cause at least one of the one or more legs 44 to deflect up or down, resulting in a change of $d_0$ to $d_1$. The angular orientation of legs 44 relative to substrates 20*a* and 20*b* will generally determine the direction of substrate deflection. When legs 44 deflect father apart, this results in an increased distance between lower surface 22*a* and upper surface 22*b*, and therefore also an increased distance between the α-particle emitting material and the neutron producing target material. Likewise, when legs 44 deflect closer together, this decreases the distance between lower surface 22*a* and upper surface 22*b*, and therefore also decreases the distance between the α-particle emitting material and the neutron producing target material. In the embodiment of FIG. 1, when lateral tension force is applied to bearings 40*a*,40*b*, legs 44 deflect closer together and the distance between surfaces 22*a*, 22*b* decreases, thereby decreasing the distance between the α-particle emitting material and the neutron producing target material. When lateral compression force is applied to bearings 40*a*, 40*b*, legs 44 deflect farther apart and the distance between surfaces 22*a*, 22*b* increases, thereby increasing the distance between the α-particle emitting material and the neutron producing target material. In certain embodiments, $d_1$ is less than $d_0$, and shifting from $d_0$ to $d_1$ causes an increase in the rate of neutrons emitted from the device. In certain embodiments, $d_1$ is greater than $d_0$, and shifting from $d_0$ to $d_1$ causes a decrease in the rate of neutrons emitted from the device.

Figure 11:
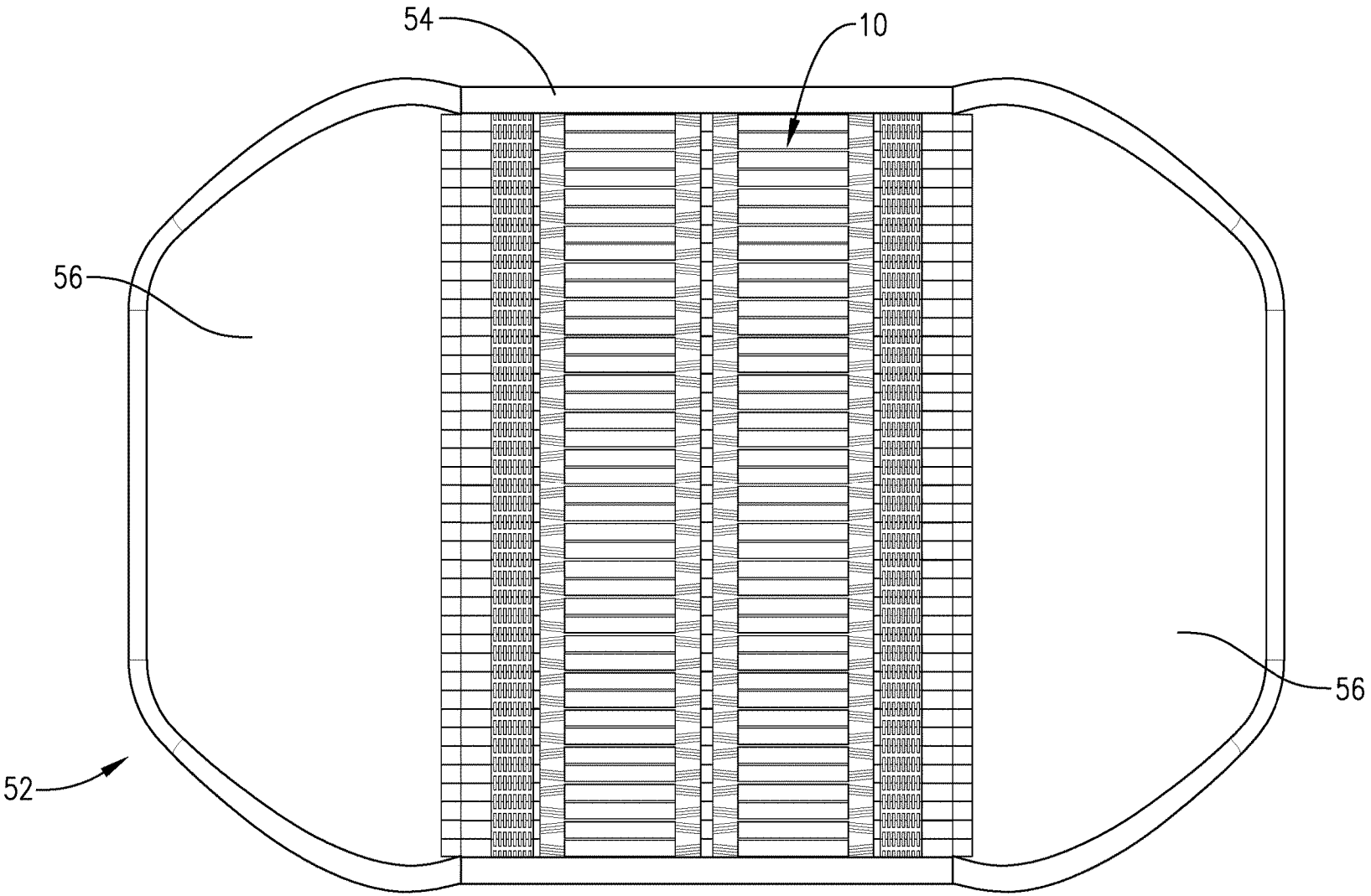
FIG. 11 is a schematic illustration of a strain gauge made in accordance with an embodiment of the present invention.

FIG. 11 depicts an exemplary strain gauge 52 that comprise a plurality of devices 10 as described above. Gauge 52 comprises a base 54 upon which devices 10 are mounted. A pair of anchor segments 56 extend laterally from the device base and provide surfaces that can engage or be engaged by the material or structure being monitored by the gauge 52. Base 54 and anchors segments 56 may comprise a variety of materials such as silicon or a plastic material like as high-density polyethylene. Gauge 52 may further comprise a casement (not shown) that can be constructed of a number of materials such as aluminum, plastics, or ceramics. In certain embodiments, gauge 52 is configured to be very compact with an overall surface dimension of approximately 1 $cm^2$. Thus, the gauge is configured to be incorporated directly into the materials that it is monitoring, rather than being applied to the outside Other modes of motion amplification are also within the scope of the present invention. For example, lever arm rotational amplification may be used in which the α-particle emitting material and/or the neutron producing material are located at the end of a lever arm, so that rotation produced about a pivot point of the lever arm results in amplified motion of the α-particle emitting material and/or the neutron producing material.

Other embodiments of the present invention are of a non-amplified type in which the displacement of the α-particle emitting material and/or the neutron producing material will be exactly proportional to the force or strain applied to the device. An exemplary non-amplifying design is a coated micro-spring. In this embodiment, a silicon substrate, for example, is etched into an "accordion" shaped spring, with the arms of the accordion being coated in the α-particle emitting material and the neutron producing material, and the α-particle attenuating medium being disposed between the accordion arms. As the spring is stretched or contracted, the rate of neutron generation is reduced or increased, respectively.

In one or more other embodiments of the present invention, there is provided a neutron emitting device configured to take advantage of the need for a line of sight to exist between at least a portion of the α-particle emitting material and the neutron producing target material. The device may be characterized by identification and analysis of the change in a view factor between the α-particle emitting material and the neutron producing target material, which results in either an increase or a decrease in the rate of neutrons being emitted by the device.

Figure 2A:
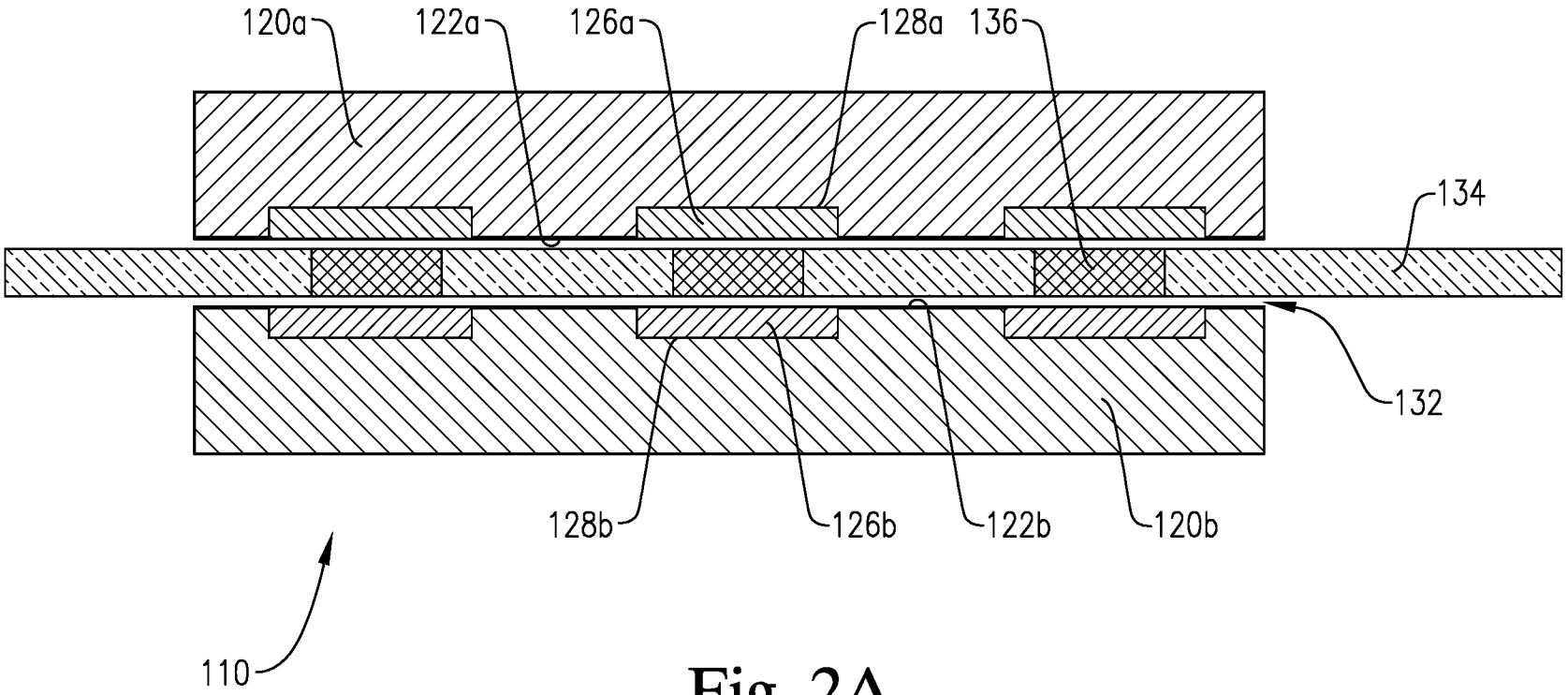
FIG. 2A is a schematic illustration of one embodiment of a view factor-type neutron emitting device utilizing a shutter to control the emission of neutrons from the device, the shutter being in the open position establishing a line of sight between the α-particle emitting material and the neutron producing material.
Figure 2B:
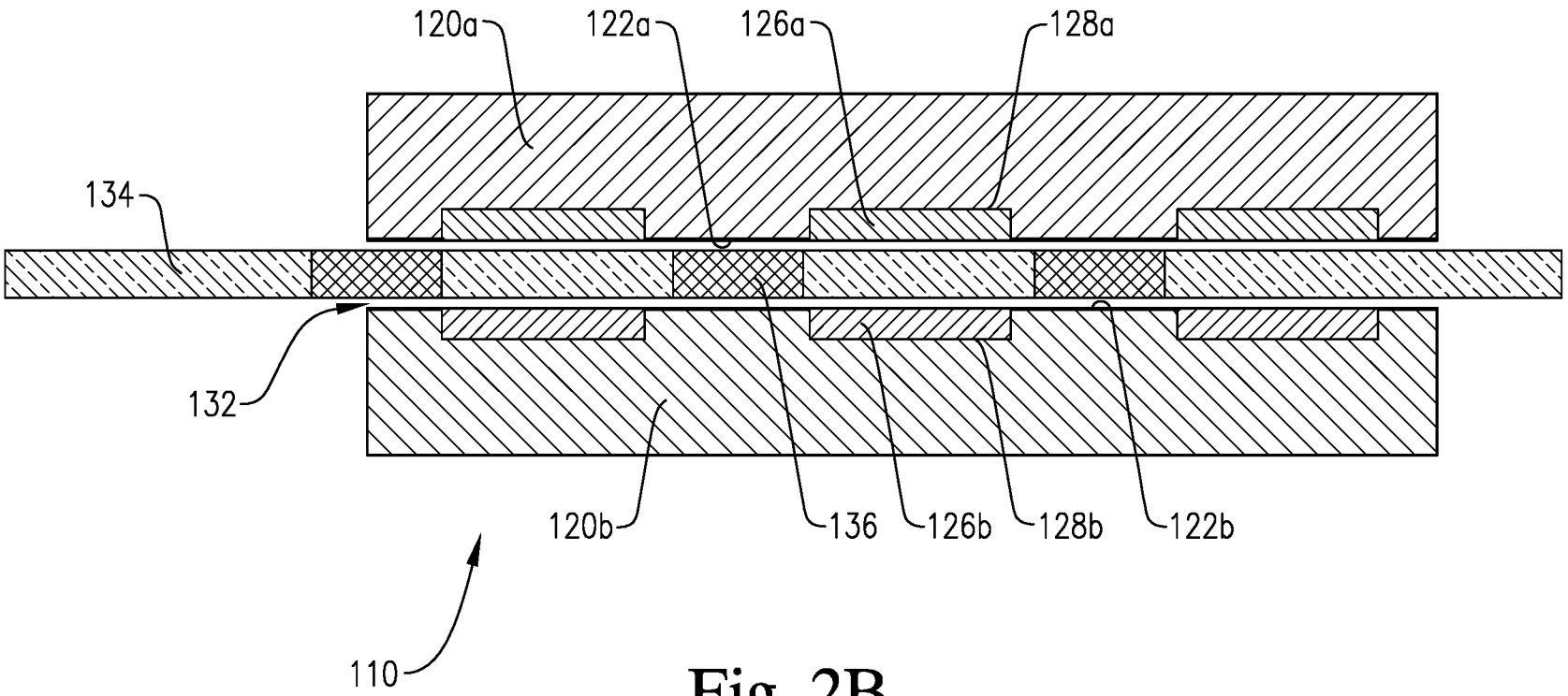
FIG. 2B is a schematic illustration of the neutron emitting device from FIG. 2A with the shutter being in the closed position to retard or prevent emission of neutrons.

A particular embodiment is device 110 shown in FIGS. 2A and 2B. Device 110 generally comprises an upper substrate 120*a* and a lower substrate 120*b*. Upper substrate 120*a* comprises an α-particle emitting material 126*a* deposited on or carried by lower surface 122*a* of upper substrate 120*a*. The α-particle emitting material 126*a* can be deposited on or in lower surface 122*a* using a variety of techniques. For example, in certain embodiments, the α-particle emitting material 126*a* is deposited on lower surface 122*a* using the same foil deposition technique described above with respect to FIG. 1. However, in certain preferred embodiments, the α-particle emitting material 126*a* is loaded onto lower surface 122*a* by creating recessed pockets or trenches 128*a* in lower surface 122*a* (for example by chemical or mechanical etching) and backfilling trenches 128*a* with the α-particle emitting material 126*a*. Lower substrate 120*b* comprises neutron producing target material 126*b* deposited on or in upper surface 122*b* of lower substrate 120*b*. Similar to the α-particle emitting material 126*a*, the neutron producing target material 126*b* can be deposited on or in upper surface 122*b* using any of a variety of techniques. For example, in certain embodiments, the neutron producing target material 126*b* is formed on upper surface 122*b* using a foil deposition technique. However, in certain preferred embodiments, the neutron producing target material 126*b* is loaded onto lower surface 122*b* by creating recessed pockets or trenches 128*b* in upper surface 122*b* (for example by chemical or mechanical etching) and backfilling trenches 128*b* with the neutron producing target material 126*b*. The precise size and geometry of trenches 128*a* and 128*b* can greatly vary, but in general they can be either shallow (about 1 to about 20 microns, preferably about 5 to about 10 microns), thereby creating parallel plates, or deep channels (about 25 to about 150 microns, preferably about 50 to about 100 microns).

Upper substrate 120*a* and lower substrate 120*b* are generally arranged in a stacked relationship with the α-particle emitting material 126*a* and the neutron producing target material 126*b* facing an interstitial space 132 between upper substrate 120*a* and lower substrate 120*b*. In certain embodiments, interstitial space 132 may have a width of from about 1 to about 20 microns, from about 2 to about 15 microns, from about 3 to about 10 microns, or about 5 microns. Typically, no α-particle attenuation material is needed in the embodiment of device 110, and thus preferably no α-particle attenuation material is present in interstitial space 132, although this need not always be the case, and in certain embodiments an α-particle attenuation material may be present in interstitial space 132 (not shown in FIG. 2A or 2B). Device 110 is configured so that neutrons are emitted when an unobstructed line of sight exists between at least a portion of the α-particle emitting material 126*a* and the neutron producing target material 126*b*. This line of sight may be established by aligning upper substrate 120*a* and lower substrate 120*b* in a desired manner so that α-particles emitted by material 126*a* can impinge upon material 126*b*.

Device 110 further comprises a shutter 134 located in between upper substrate 120*a* and lower substrate 120*b*. Shutter 134 is generally shiftable between a closed position that blocks the line of sight between the α-particle emitting material 126*a* and the neutron producing material 126*b* and an open position that establishes a line of sight between the α-particle emitting material 126*a* and the neutron producing material 126*b*. Shutter 134 can be a variety of shapes and the thicknesses, depending on the particular application and the material(s) from which shutter 134 is comprised. However, shutter 134 is preferably made of a suitable material, density, and/or thickness so as to absorb or block substantially all of the α-particles emitted from α-particle emitting material 126*a* from interacting with neutron producing material 126*b* when shutter 134 is in the closed position. Preferred α-particle blocking materials include certain plastics (e.g., high density polyethylene), metals (e.g., metal foil or sheets), composite materials, and the like. However, a variety of other α-particle blocking materials can be used in accordance with the present invention. For example, the shutter may comprise an attenuating fluid that can be delivered and evacuated from the interstitial space between materials 126*a* and 126*b* by a microfluidic device.

As best shown in FIGS. 2A and 2B, shutter 134 may comprise a plurality of apertures 136 formed therein. FIG. 2A shows device 110 with shutter 134 configured in the open position. When shutter 134 is in the open position, apertures 136 at least partially align with the α-particle emitting material 126*a* and the neutron producing material 126*b* to allow interaction between these materials and neutron emission from device 110. FIG. 2B shows device 110 with shutter 134 configured in the closed position. When shutter 134 is in the closed position, apertures 136 are offset from at least one of the α-particle emitting material 126*a* and/or the neutron producing material 126*b*, thereby blocking the line of sight between when these materials and preventing neutron emission from device 110.

In another embodiment of the present invention, shutter 134 and neutron producing material 126*b* can be used in connection with a machine (not illustrated) that is capable of generating a particle beam, such as a particle accelerator, and directing the particles toward the shutter and neutron producing material for the purpose of producing neutrons. Thus, in this embodiment, the passive source of α-particles 126*a* need not be present. Further, this embodiment of the present invention is not limited to use of α-particles for generating neutrons. The generated particle beam can comprise protons and even heaver particles having a larger nucleus than α-particles. During use of this system, the shutter 134 can be shifted as desired to either permit the particle beam to impinge upon or be blocked from the neutron producing material thereby selectively generating neutrons when desired.

While FIGS. 2A and 2B illustrate shutter 134 and neutron producing material 126*b* as being planar materials residing in parallel planes, it is within the scope of the present invention for shutter 134 and neutron producing material 126*b* to be arranged as nested and/or concentric cylinders, with one or both of shutter 134 and neutron producing material 126*b* to be rotatable. The α-particle emitting material 126*a* or machine providing a particle beam can be placed in the center of the cylinders. Rotation of at least shutter 134 would then permit the production of neutrons to be cycled on an off as desired.

Figure 3:
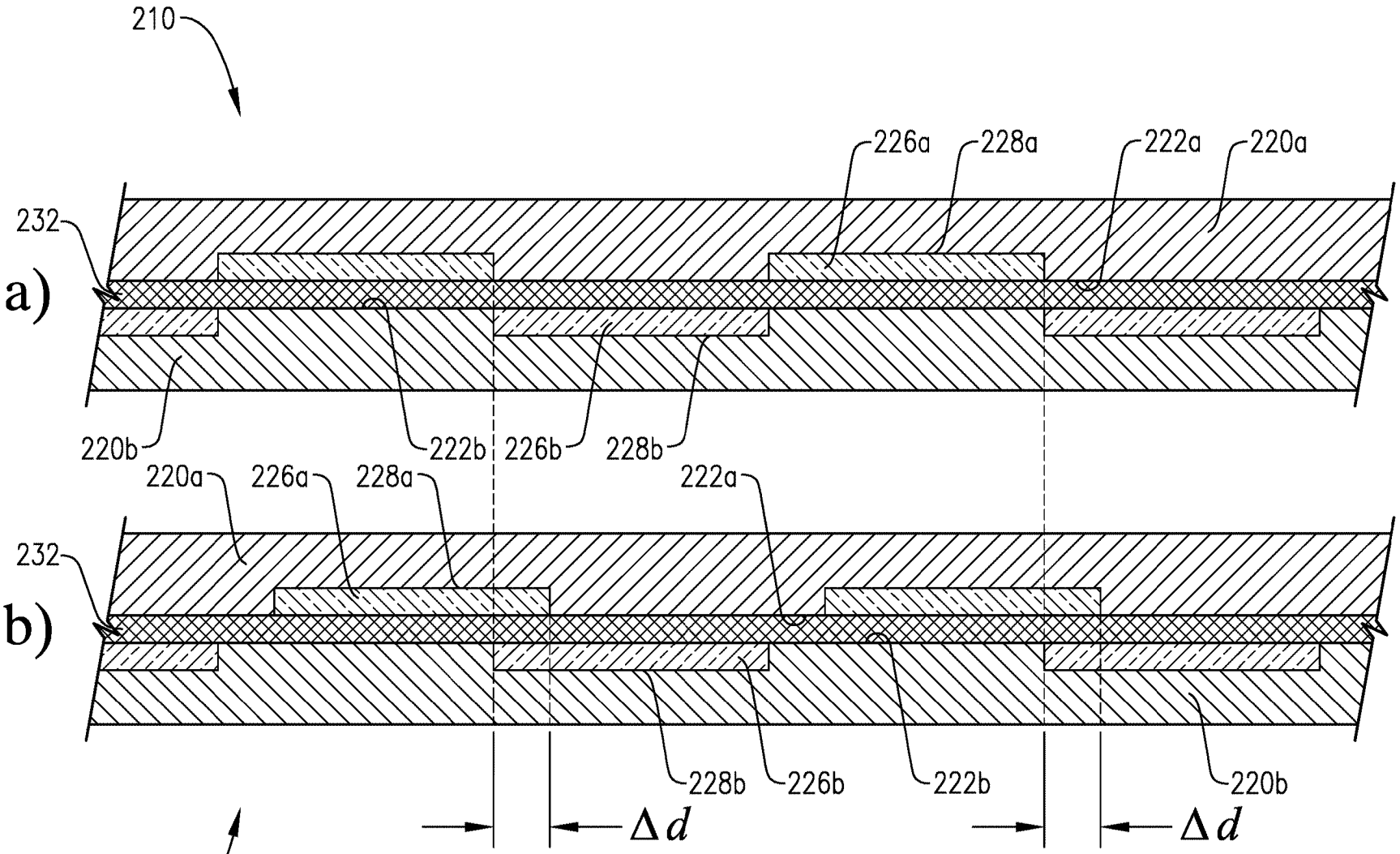
FIG. 3 is a schematic illustration of another embodiment of a view factor-type neutron emitting device wherein the opposed substrates containing the α-particle emitting material and the neutron producing material are shiftable into and out of alignment, with (a) depicting a closed configuration, and (b) depicting an open configuration.

Another embodiment of the present invention that takes advantage of the view factor characteristic, is device 210, shown in FIG. 3. Similar to device 110, device 210 generally comprises an upper substrate 220*a* and a lower substrate 220*b*. Upper substrate 220*a* comprises an α-particle emitting material 226*a* deposited on or in lower surface 222*a* of upper substrate 220*a*, and lower substrate 220*b* comprises neutron producing target material 226*b* deposited on or in upper surface 222*b* of lower substrate 220*b*. The α-particle emitting material 226*a* and neutron producing target material 226*b* can be formed on or in lower surface 222*a* and upper surface 222*b*, respectively, using any variety of techniques, including the foil deposition and etching/backfilling techniques described above. As with device 110, the precise size and geometry of trenches 228*a* and 228*b* in device 210 can greatly vary, but in general they can be either shallow (about 1 to about 20 microns, preferably about 5 to about 10 microns), thereby creating parallel plates, or deep channels (about 25 to about 150 microns, preferably about 50 to about 100 microns).

As shown in FIG. 3, upper substrate 220*a* and lower substrate 220*b* are generally arranged the first and in a stacked relationship with the α-particle emitting material 226*a* and the neutron producing target material 226*b* facing an interstitial space 232 between upper substrate 220*a* and lower substrate 220*b*. In certain embodiments, interstitial space 132 may have a width of from about 1 to about 20 microns, from about 2 to about 15 microns, from about 3 to about 10 microns, or about 5 microns. As with device 110, no α-particle attenuation material is needed in the embodiment of device 210, and thus preferably no α-particle attenuation material is present in interstitial space 232 although this need not always be the case, and in certain embodiments an α-particle attenuation material may be present in interstitial space 232 (not shown in FIG. 3). Most preferably, interstitial space is occupied by a gas, such as air.

As best shown in comparing configurations (a) and (b) in FIG. 3, the relative positions of upper substrate 220*a* and lower substrate 220*b* are shiftable between a closed position in which the α-particle emitting material 226*a* and the neutron producing target material 226*b* are offset (position a) and an open position in which the α-particle emitting material 226*a* and the neutron producing target material 226*b* are at least partially aligned (positioned b). When in the closed position (a), no line of sight exists between the α-particle emitting material 226*a* and the neutron producing target material 226*b*, and thus the interaction between these materials is blocked, which prevents neutron emission from device 210. When in the open position (b), upper substrate 220*a* and lower substrate 220*b* are at least partially aligned such that a line of sight exists between at least a portion of the α-particle emitting material 226*a* and the neutron producing target material 226*b* across interstitial space 232. Additionally, the degree of alignment can be increased by increasing Δd in the open position (b), which changes the view factor between the α-particle emitting material 226*a* and the neutron producing target material 226*b*. This change in view factor results in a change (can be either an increase or a decrease) in the rate of neutrons being emitted by the device 210.

Devices and methods of the present invention can advantageously use either passive or active mechanisms to cause movement of components that result in the changes in the rate of neutron emission described above. In particularly preferred embodiments, the neutron emitting device is a passive device. Passive devices utilize the neutron-producing interaction between the α-particle emitting material and the neutron producing target material when the materials are in appropriate proximity and/or line of sight. During operation of the passive device, the materials are in an initial position such that neutrons are either emitted or not emitted from the device. However, the passive device is configured a change the relative position of the materials in response to conditions, such as environmental conditions, external to the neutron emitting device. For example, with respect to device 10 of FIG. 1, the relative positions of the shuttles may change in distance from $d_0$ to $d_1$ in response to external conditions, without the need for the device to be connected to a controlling device via wires, thereby changing the output of neutrons from the device. In the embodiments of FIGS. 2A, 2B, and 3, a change in conditions external to the passive device results in a change in the view factor between the materials, thereby changing the output of neutrons from the device. Exemplary passive device applications include strain gauges and fast-transient shut-off devices, such as safety valves and circuit breakers.

Figure 4:
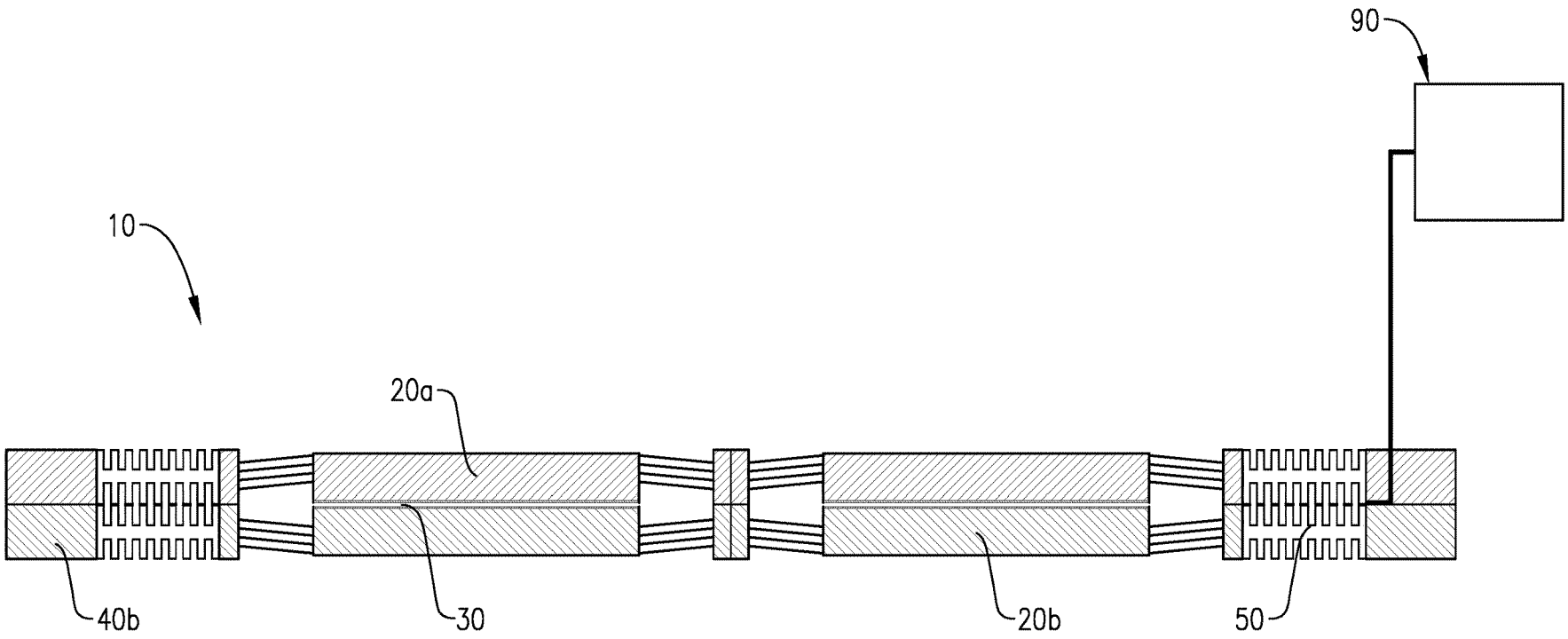
FIG. 4 is a schematic illustration of one embodiment of an attenuating-type active neutron emitting device including a controller in accordance with the present invention.

In other preferred embodiments, the neutron emitting device is an active device. In certain embodiments, the active device is operably connected to a controller 90. Controller 90 may comprise for example, a sensor configured to detect a change in a condition external to the device, such as a temperature or pressure, and/or controller 90 may comprise a processor configured to receive an input from a user or from a sensor and provide an output to the device that effects a change in the device's geometry. When the controller 90 is attached to device 10 (see FIG. 4), the change in distance from $d_0$ to $d_1$ is selectively effected by the controller 90 operably coupled to the neutron emitting device, which results in either an increase or decrease in the rate of neutrons emitted by the active device. This controller 90 may effect this change in distance by selectively imposing lateral compression or tension forces on the bearings. When the controller is attached to device 110 or device 210, the controller selectively changes the configuration of the device between a closed position in which no line of sight exists between the α-particle emitting material and the neutron producing target material, and an open position in which a line of sight exists between at least a portion of the α-particle emitting material and the neutron producing target material. This selective change in view factor results in selectively increasing or a decreasing the rate of neutrons emitted by the active device. Exemplary active device applications include those where selective production of neutrons may be increased or decreased as desired, such as oil well logging tools, bomb-detection equipment, boron neutron capture therapy machines, soil density gauges, and reactor start-up sources. Thus, devices made in accordance with the present invention can be used to carry out identification of geological formations, detection of bombs, medical therapies, analysis of materials, such as soil or structures, and to initiate reactions, particularly nuclear reactions.

Figure 5:
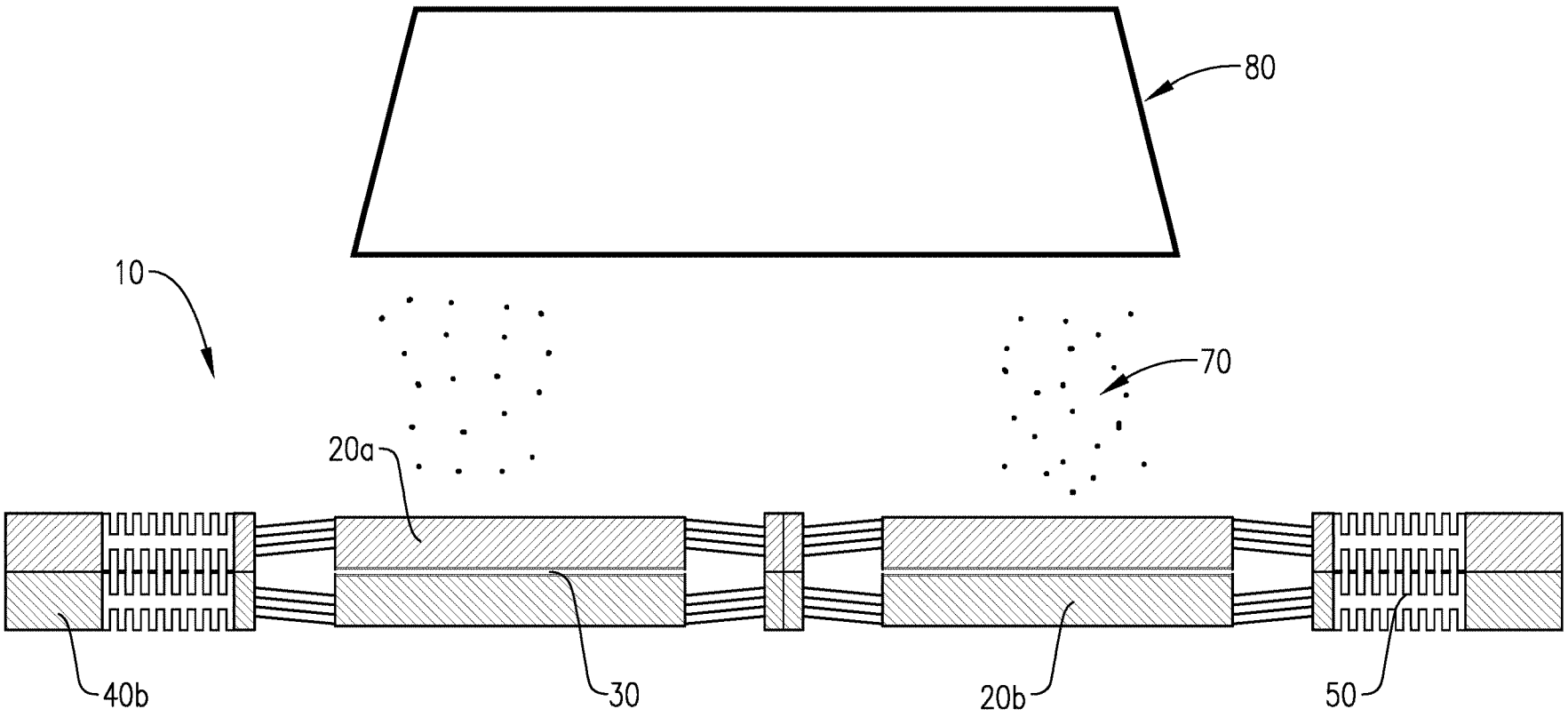
FIG. 5 is a schematic illustration of one embodiment of an attenuating-type neutron emitting device used in conjunction with a neutron detector in accordance with the present invention.

In certain embodiments, the neutron emission device can be used in conjunction with a neutron detector. FIG. 5 shows a neutron detector 80 positioned adjacent device 10 so as to detect the neutrons 70 being emitted from device 10. A neutron detector is particularly useful in passive devices to detect a change in neutron emissions from the device, which occurs due to a change in an environmental condition. However, a neutron detector may also be used in conjunction with an active neutron emission device, for example, to detect differences in neutron emission and neutron detection that may evidence an environmental condition being monitored.

One exemplary application for the devices and methods of the present invention includes soil analysis and soil moisture analysis applications. In such applications, the neutron emission device is inserted into the soil and is activated to selectively emit neutrons. The neutrons emitted from the device interact with soil water (or other target fluid). The density of the neutron flux is dependent upon the amount of water (or fluid) in the surrounding soil, and a neutron detector is used to monitor the neutron flux of slow neutrons scattered by the soil. The neutrons are slowed by collisions with atoms in the soil, particularly hydrogen atoms from water and possible hydrocarbons. The devices and methods may be used for both terrestrial and extra-terrestrial soil analysis.

EXAMPLE

The following example describes devices and methods according to certain embodiments of the present invention. It is to be understood, however, that these examples are provided by way of illustration and nothing therein should be taken as a limitation upon the overall scope of the invention.

Mechanical strain gauges are frequently used in real time load sensing for failure analysis, machine maintenance, etc. To address the dependence of an analogue electrical signal for conventional strain gauge operation, a strain sensitive neutron source is considered. Such a device would use the short range of americium-241 α-particles to interact with a beryllium target to produce neutrons. Applying strain to the device alters the geometry of the device, especially separation distance or viewing factor between α-particle emitting material and the target, resulting in variation of neutron output. Several MEMS designs were considered which utilized both attenuating medium such as mercury, and movement of apertures. It was found that some form of linear amplification is preferred to measure deformation below 1000 μ-strain. The most successful designs utilized chevron style linear motion amplification and gave a relative neutron output of 1.37 at 1000 μ-strain in tension, 0.73 at 1000 μ-strain in compression; absolute neutron output at zero strain was determined to be 3576 neutrons per second for this design.

1. Introduction

Mechanical strain gauges provide real time measurement of material deformation caused by high stress loads. For most practical applications, strain is the only measurable evidence of stress being applied to a material and is defined (for the one dimensional case) as the change in length divided by the initial length ($\epsilon=\Delta l/lo$). Conventional strain gauges are electronic devices which rely on the precise measurement of electrical resistance. As such, they are vulnerable to analog signal noise due to vibrations, EMF interference, etc. Additionally, they require a physical wire connection to a measuring device in order to receive supply power.

Below, strain measurement using a strain varying neutron source is described. Such a device can be bonded to a material similar to a conventional strain gauge but does not require wire leads or any form of electrical power. The strain is instead deduced by measuring changes in the neutron output of the device. This property allows the device to be more deeply embedded in the structural material being monitored. Some examples of use-cases would include the interiors of pressure vessels, within concrete structures, or embedded in fiber reinforced polymers such as in aircraft wings.

2. Variable Neutron Source Physics

The devices tested were designed to utilize the (α, n) nuclear reaction to produce fast neutrons. In this case, americium-241 dioxide was chosen as the isotropic alpha particle emitter and beryllium oxide as the low Z target material to generate neutrons with energies averaging 4 MeV. In most americium-beryllium (AmBe) neutron sources, the two materials are homogeneously mixed and sealed to maximize neutron output. However, in the case of these proposed devices, the alpha emitter and target are separated by some initial distance $d_0$, and neutron output is determined by the geometry of the device.

Figure 6:
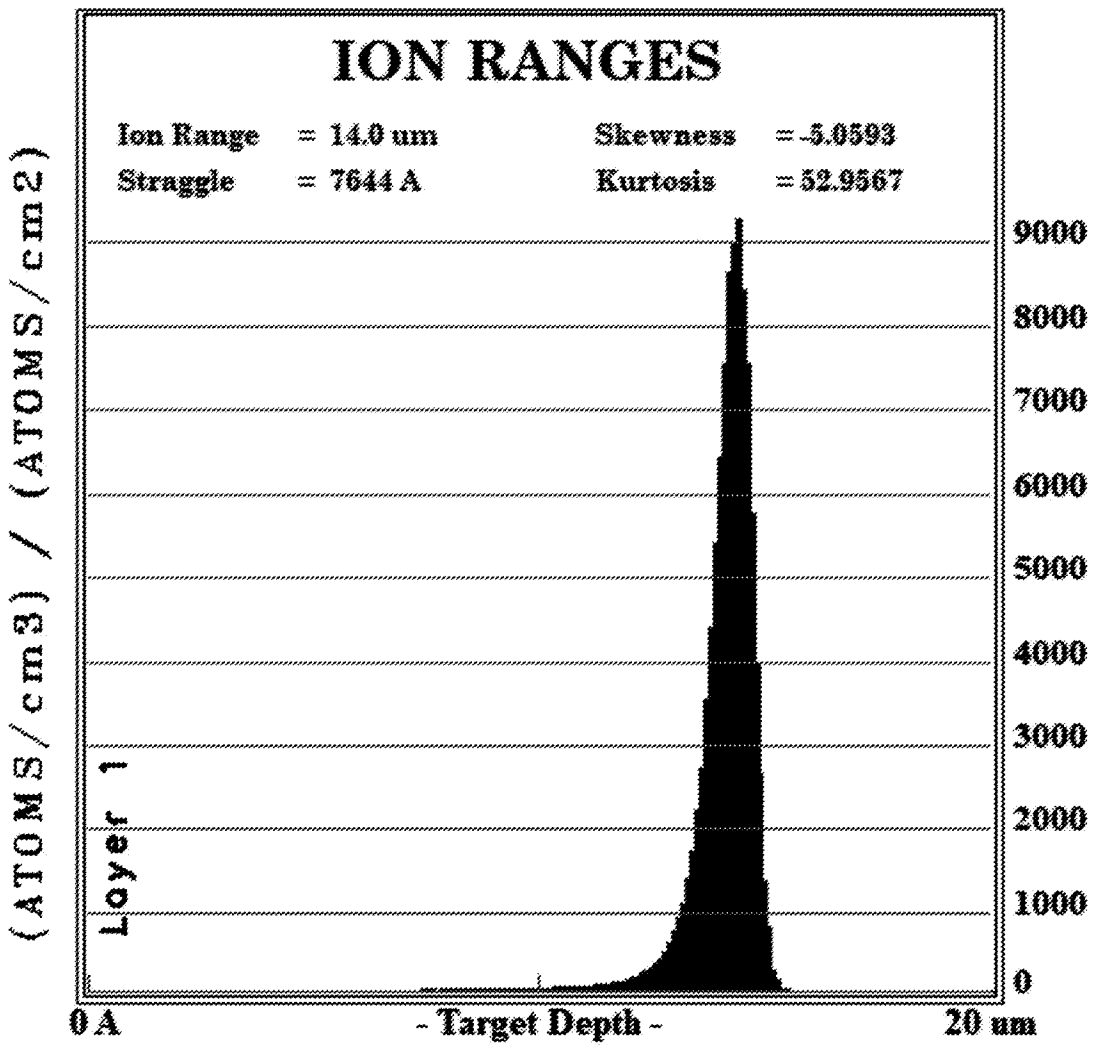
FIG. 6 is a chart depicting the Bragg curve of americium-241 α-particles in liquid mercury.

Variation of neutron output is coupled to two distinct properties of the device geometry: attenuation of alpha particles and variation of alpha emitter view factor. Attenuation exploits the short range of alpha particles in dense medium to reduce the straggle of their associated Bragg peak. Liquid mercury in particular provides a dense attenuating fluid that can accommodate a deforming strain gauge. In the case of americium-241 α-particles in liquid mercury, the Bragg peak is centered at 14.0 μm, with a standard deviation of only 764 nm. See, FIG. 6. Hence, these designs, which utilize liquid mercury, have a $d_0$=14.0 μm. At that initial spacing, a small change in separation distance results in a large change in alpha interactions in the target, and therefore a proportional change in neutron production.

Figure 7:
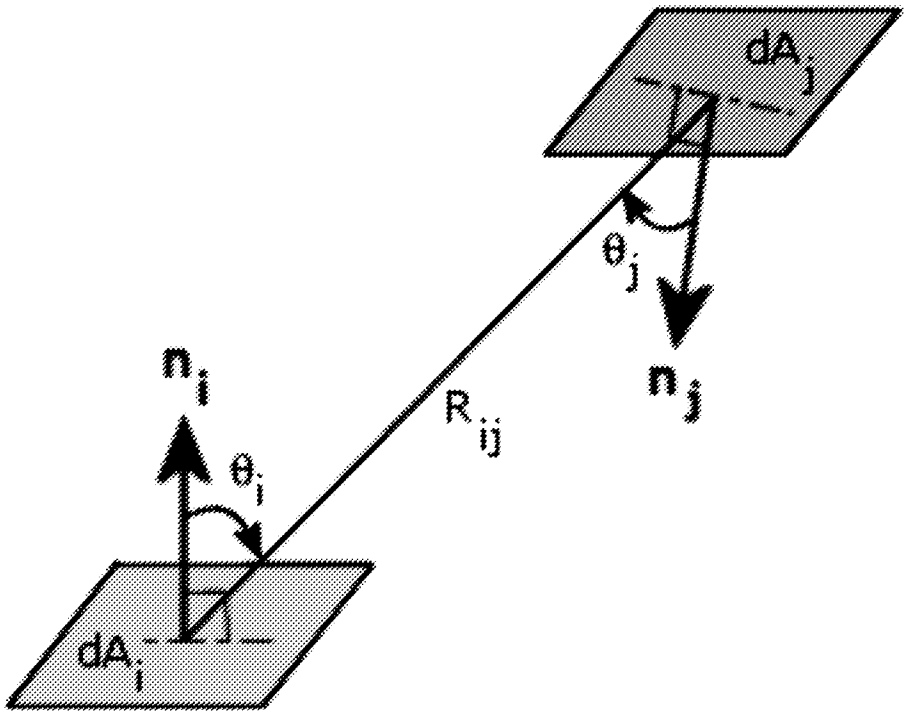
FIG. 7 is an illustration of view factor shadowing of two arbitrary surfaces, the surfaces can be infinitesimal or finite.

View factor is a property which describes the geometric line-of-sight between an emitting and target surface. From FIG. 7, for finite surfaces $A_i$ and $A_j$, the view factor can be calculated from $$F_{ij} = \frac{1}{A1}\int_{A1}\int_{A2}\frac{\cos\theta_i\cos\theta_j}{\pi R_{ij}^2}dA_i dA_j$$

where $\theta_n$ are the unit normal angles of each surface. View factor is also affected by secondary surfaces, which can cause shadowing in a geometry. Neutron production is directly proportional to the sum view factor $F_{ij}$ between the alpha emitter and target material.

3. Modeling Design Geometries

To determine the efficacy of each design, the devices were first modeled in Dassault Systemes Solidworks and tested for deformation under fixed strain conditions. Afterward, representative designs were modeled in PHITS 2.88 Monte Carlo code for heavy ion transport and nuclear reactions to determine neutron output. Each device is modeled as being embedded in a 2 cm aluminum slab surrounded by air at sea level. The device substrate material is crystalline non-doped silicon. Emitted alpha particles are defined as isotropically emitting and with discrete energies as defined below:

TABLE 1

Discrete emission energies and branching ratios for americium-241 α particles

| Energy (MeV) | Branching Ratio |
|---|---|
| 5.586 | 0.85 |
| 5.443 | 0.13 |
| 5.388 | 0.02 |

3.1. Design Criteria

As well as utilizing the techniques mentioned above, each design adhered to the general design criteria outlined below:

- Device must provide good displacement per unit strain. For example, a 1 cm rigid device which experiences 1000 μ-strain will displace 10 micron overall.
- Must be scalable (stackable) to a 1 $cm^2$ device. Additionally, any design is patterned to entirely use an area of one square centimeter.
- Configuration should allow some reasonable way for the materials (americium dioxide foil, beryllium) to be deposited onto them.
- Design must not break under stress. This is defined as 50% of tensile strength at 1000 μ-strain.

3.2. Attenuation Device Designs

Designs in this category can be separated into non-amplified and amplified types. A non-amplified design will experience displacement exactly proportional to the strain applied to the device for each element ($\Delta d=d_0\epsilon$). Amplified designs will have some amplification function which varies with strain ($\Delta d=d_0 f(\epsilon)$, where $f(\epsilon)>\epsilon$).

A simple case of a non-amplifying design is a coated microspring. A silicon substrate is etched into an "accordion" shaped spring, with arms of the accordion being coated in americium or beryllium, alternated along the length of the spring.

Two simple forms of motion amplification are considered in this design study: lever arm rotational amplification, and "chevron" style linear actuators. These devises can have americium and/or beryllium deposited on their regions of greatest displacement i.e. cantilever tip for levers or shuttle surfaces for chevrons, see FIGS. 8 and 9.

Figure 8:
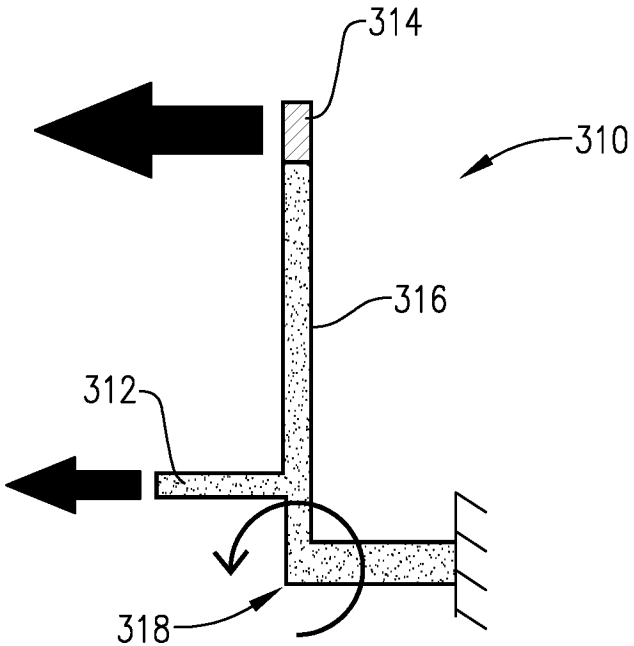
FIG. 8 is a schematic illustration of MEMS amplification using a lever arm cantilever.

As shown in FIG. 8, lever 310 comprises projection 312, where a force can be applied causing rotation around fulcrum point 318, and a cantilever tip 314 at a distal end of rod 316 from projection 312. When a force is applied at projection 312, the distance traveled by cantilever tip 314 is greater than the distance traveled by projection 312. Since the americium, beryllium, or other reactive material is located at the cantilever tip 314, the signal effected by the change in distance between reactive materials is an amplified signal compared to the distance traveled by projection 312.

Figure 9:
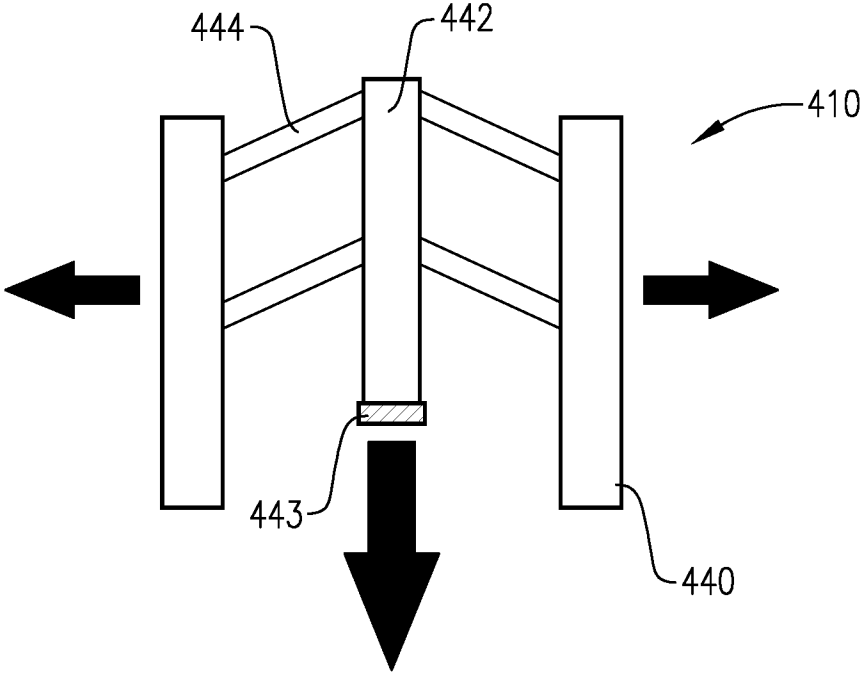
FIG. 9 is a schematic illustration of a single-sided chevron with four "legs" and a single center shuttle for MEMS amplification.

As shown in FIG. 9, chevron actuator 410 comprises a pair of anchors 440 and a central moveable shuttle 442, connected by one or more pairs of deflectable legs 444. When a compression or tension force is applied to anchors 440, legs 444 are deflected and the distance traveled by shuttle end 443 (comprising the reactive material) is greater than the distance traveled by anchors 440. Thus, the signal effected by the change in distance between reactive materials is an amplified signal compared to the distance traveled by anchors 440.

Three representative geometries were chosen for attenuation type devices:

1. Accordion spring with 5 micron wide legs, spaced 14 micron apart.
2. Chevrons with 60 micron wide shuttles.
3. Chevrons with 1800 micron wide shuttles.

3.3. View Factor Designs

These designs generally utilize two silicon dies which pass over each other. Each die contains recessed pockets or trenches backfilled with either α-emitter or target material. See, FIG. 3. Geometry of the recesses can greatly vary, but in general they can be either shallow (creating parallel plates) or deep channels (creating apertures). Applying strain to the devices would cause the dies to slide relative to each other, resulting in some displacement Δd.

The two following geometries are chosen as representative designs for this type of device:

1. 50 micron wide "aperture" trenches, 100 micron deep, 50 micron backfill.
2. 50 micron wide shallow "plates", 5 micron deep, 5 micron backfill.

4. Results

Figure 10:
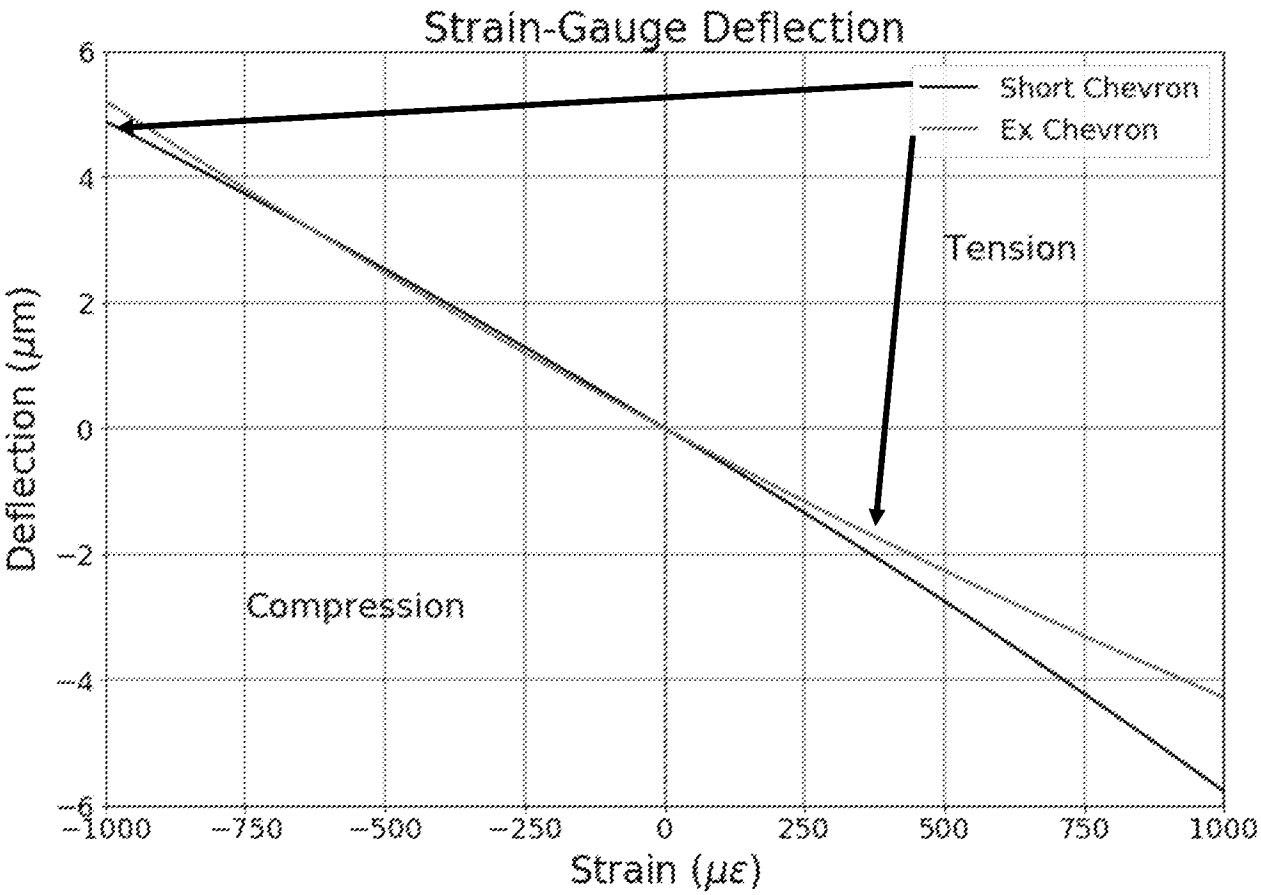
FIG. 10 is a chart of element displacement versus strain for chevron style devices.

Initial mechanical simulations were performed to collect displacement figures for particle transport simulations. Notably the chevron-based designs did not experience vertical displacement linearly proportional to lateral strain applied. The deflection trends were also asymmetric, with greater linear deviation occurring closer to the extreme ends of applied strain (FIG. 10).

To prevent structural failure of the long style shuttle, additional damping springs were added to the ends of the device to reduce stress on the chevron legs. See, FIG. 1. Table 2 shows absolute neutron production of each device at zero strain:

TABLE 2

Neutron emissions for representative designs modeled in PHITS 2.88

| Device | Neutron Production (nps) |
|---|---|
| Accordion | 52.3 |
| Short Chevron | 15.3 |

TABLE 2-continued

Neutron emissions for representative designs modeled in PHITS 2.88

| Device | Neutron Production (nps) |
|---|---|
| Long Chevron | 3576 |
| Aperture Dies | 1231.5 |
| Plate Dies | 2344.6 |

From relative neutron production simulations, "accordion" style designs were less preferred. For the design considered, the accordion legs displaced only 14 nanometers, much less than the range of the alpha particles.

5. Conclusions and Discussion

The results given above are only intended to give qualitative comparisons of radically different designs that achieve a similar effect.

It was discovered that chevron style devices provide the greatest amount of emission material and linear amplification but could be complicated to manufacture. In general, it some form of mechanical amplification may be preferred in order for displacement based devices to function properly, even in a dense attenuating medium like liquid mercury.

We claim:

1. A neutron emitting device comprising:

an α-particle emitting material located on a first substrate;

a neutron producing target material located on a second substrate; and an α-particle attenuating material disposed therebetween, the α-particle emitting material and the neutron producing material being oriented in facing relationship and initially separated from each other by a distance, $d_0$, the distance between the first and second substrates being variable between $d_0$ and a second distance $d_1$ due to a change in the position of at least one of the first and second substrates, the change in position from $d_0$ to $d_1$ resulting in a change in the rate of neutrons emitted by the device, wherein the first and second substrates each comprise a movable shuttle having spaced apart end segments, each of the end segments being secured to a bearing by one or more legs, and wherein an application of a force to at least one of the bearings causes at least one of the one or more legs to deflect resulting in the change of $d_0$ to $d_1$, and wherein the device comprises at least one dampener located in between at least one of the one or more legs and one of the bearings.

2. The neutron emitting device of claim 1, wherein either:

$d_1$ is less than $d_0$, and shifting from $d_0$ to $d_1$ causes an increase in the rate of neutrons emitted from the device; or $d_1$ is greater than $d_0$, and shifting from $d_0$ to $d_1$ causes a decrease in the rate of neutrons emitted from the device.

3. The neutron emitting device of claim 1, wherein the neutron emitting device is a passive device.

4. The neutron emitting device of claim 1, wherein the neutron emitting device is operably connected to a controller that selectively effects the change in position from $d_0$ to $d_1$.

5. The neutron emitting device of claim 1, wherein the α-particle emitting material comprises americium-241, and wherein the neutron producing target comprises beryllium.

6. A method of selectively producing neutrons comprising:

providing a neutron emitting device comprising an α-particle emitting material on a first substrate, a neutron producing target material located on a second substrate, and an α-particle attenuating material disposed therebetween, the α-particle attenuating material and the neutron producing material being oriented in facing relationship and initially separated from each other by a distance, $d_0$; and changing, or causing to change, the distance between the first and second substrates to a second distance $d_1$, the change in distance resulting in a change in the rate of neutrons emitted from the device, wherein the first and second substrates each comprise a movable shuttle having spaced apart end segments, each of the end segments being secured to a bearing by one or more legs, and wherein an application of a force to at least one of the bearings causes at least one of the one or more legs to deflect resulting in the change of $d_0$ to $d_1$, and wherein the device comprises at least one dampener located in between at least one of the one or more legs and one of the bearings.

7. The method of claim 6, wherein $d_1$ is less than $d_0$, and wherein the change in distance from $d_0$ to $d_1$ results in an increase in the rate of neutrons emitted from the device.

8. The method of claim 6, wherein $d_1$ is greater than $d_0$, and wherein the change in distance from $d_0$ to $d_1$ results in a decrease in the rate of neutrons emitted from the device.

9. The method of claim 6, wherein the change in distance from $d_0$ to $d_1$ is a passive response to a change in conditions external to the neutron emitting device.

10. The method of claim 6, wherein the change in distance from $d_0$ to $d_1$ is effected by a controller operably coupled to the neutron emitting device.

* * * * *